US012490778B2

(12) United States Patent
Whalen et al.

(10) Patent No.: US 12,490,778 B2
(45) Date of Patent: Dec. 9, 2025

(54) SUPPORTIVE GARMENT

(71) Applicant: Little Movements, Inc., Firth, NE (US)

(72) Inventors: Marissa Whalen, Firth, NE (US); Lyndsey Haag, Hickman, NE (US); Jaclyn Tejeda, Firth, NE (US)

(73) Assignee: Little Movements, Inc., Firth, NE (US)

( * ) Notice: Subject to any disclaimer, the term of this patent is extended or adjusted under 35 U.S.C. 154(b) by 0 days.

(21) Appl. No.: 18/386,970

(22) Filed: Nov. 3, 2023

(65) Prior Publication Data

US 2024/0148083 A1 May 9, 2024

Related U.S. Application Data

(60) Provisional application No. 63/422,382, filed on Nov. 3, 2022.

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
USPC ..... 450/70
See application file for complete search history.

(56) References Cited

U.S. PATENT DOCUMENTS 3,120,848 A * 2/1964 Seperack ..... A41C 3/00 450/86
3,186,412 A * 6/1965 Kurland ..... A41C 3/00 450/86
3,220,415 A * 11/1965 Marino ..... A41C 3/00 450/86
3,465,754 A * 9/1969 Lockwood ..... A41C 3/00 450/86
4,174,717 A * 11/1979 Schreiber ..... A41C 3/0057 450/86

(Continued)

FOREIGN PATENT DOCUMENTS

| | | |
|---|---|---|
| CA | 129613 S | 9/2010 |
| GB | 6116884 S | 3/2021 |
| GB | 6180166 S | 10/2022 |

OTHER PUBLICATIONS

Black Liquid Leather Cross Back Bra (LA-LIQS-1031_BLACK), published May 26, 2022, https://lasociety.com/products/la-liqs-1031_black-liquid-leather-cross-back-bra?variant=43904994672896.

FITTIN Cross Back Sports Bra, posted Jun. 27, 2017 (online), (retrieved Nov. 30, 2023). Retrieved from the internethttps://www.amazon.ca/Fittin-Crossback-Sports-Bras-White/dp/B072Q477YB (Year: 2017).

(Continued)

*Primary Examiner* — Gloria M Hale
(74) *Attorney, Agent, or Firm* — Suiter Swantz IP

(57) ABSTRACT

A supportive garment may include a front panel for chest coverage. The front panel may include a first inner layer with fixed cupless padding, and a second inner layer of perforated fabric securely overlaying and fixed to the cupless padding. The front panel may include an outer layer, which encases the first and second inner layers, composed of elastic fabric. The supportive garment may include a set of straps. The set of straps may attach to an upper portion of the front panel at one end, wrapping over the shoulders of a user, and a side portion of the front panel at another end, partially wrapping around a torso of the user. The supportive garment may also include a bottom band affixed to a bottom portion of the front panel and the set of straps, which defines a torso opening and ensures a secure fit.

18 Claims, 11 Drawing Sheets

(56) References Cited

U.S. PATENT DOCUMENTS

| | | | | |
|---|---|---|---|---|
| 4,220,157 | A * | 9/1980 | Clark | A41C 3/0021 450/86 |
| 4,311,150 | A * | 1/1982 | Schreiber | A41C 3/0057 450/86 |
| 4,583,544 | A * | 4/1986 | Flanagan | A41C 3/0057 2/67 |
| 4,816,005 | A * | 3/1989 | Braaten | A41C 3/02 450/74 |
| 6,302,761 | B1 * | 10/2001 | Wrenn | A41F 1/006 450/86 |
| D668,837 | S | 10/2012 | Palladino | |
| D835,884 | S | 12/2018 | Alligood | |
| 10,321,723 | B2 * | 6/2019 | Kelley | A41C 3/0057 |
| D911,667 | S | 3/2021 | Mohamed | |
| D932,134 | S | 10/2021 | Mohamed | |
| D963,289 | S | 9/2022 | Wormgoor | |
| D995,038 | S | 8/2023 | Breitwieser | |
| 2005/0255789 | A1 * | 11/2005 | Gaudet | A41C 3/0085 450/41 |
| 2018/0279692 | A1 * | 10/2018 | Witek | A41C 5/00 |
| 2019/0082749 | A1 | 3/2019 | Ward et al. | |
| 2019/0110524 | A1 * | 4/2019 | Kelley | A41F 15/00 |
| 2019/0216141 | A1 * | 7/2019 | Witek | D04B 1/246 |
| 2020/0037673 | A1 | 2/2020 | Storelli et al. | |
| 2023/0346050 | A1 | 11/2023 | Mayes | |
| 2024/0315358 | A1 * | 9/2024 | Fatuova | A41C 3/0057 |

OTHER PUBLICATIONS

How to apply a rounded corner to only one corner of a ui. (online) 2 pgs. Jul. 2020, (retrieved May 23, 2023)https://devforum.roblox.com/t/how-to-apply-a-rounded-corner-to-only-one-corner-of-a-ui/697979.

TFL Hyper-Power Workout Sports Bra, reviewed as early as Dec. 7, 2022 (online), (retrieved Nov. 29, 2023). Retrieved from the internethttps://tlfapparel.com/products/tlf-hyper-power-workout-sports-bra-purple-crush?variant=41925047189700&currency=USD&utm_medium=product_sy%ED2%80%A6 (Year: 2022).

Woo Yoga Charlotte Corset Bra, published Oct. 20, 2022, https://wooyoga.com/products/charlotte-corset-bra.

ACXLONG Sports Bra, posted Jul. 15, 2021 [online], (retrieved Sep. 9, 2024). Retrieved from the internet, https://www.amazon.com/Sports-Women-Running-Workout-Aesthetic/dp/B099J KC6K3?th=1 (Year: 2021).

FITTIN Sports Bra, posted Jun. 27, 2017 [online], (retrieved Nov. 30, 2023). Retrieved from the internet, https://www.amazon.ca/Fittin-Crossback-Sports-Bras-White/dp/B072Q4 77YB (Year: 2017).

TFL Hyper Power Workout Sports bra, review as early as Dec. 7, 2022 [online], (retrieved Nov. 29, 2023). Retrieved from the internet, https ://tlfapparel. co m/products/tlf-hyper -power -workout-sports-bra-pu rple-crush?vari ant=4192504 7189700ocy=USD&utm_medium=product_sy%E2%80%A6 (Year: 2022).

* cited by examiner

SUPPORTIVE GARMENT

CROSS-REFERENCE TO RELATED APPLICATION

The present application claims the benefit under 35 U.S.C. § 119(e) of U.S. Provisional Application Ser. No. 63/422,382, filed Nov. 3, 2022, which is incorporated herein by reference in the entirety.

TECHNICAL FIELD

The present disclosure relates generally to brassieres, and, more particularly, to a cupless brassier adapted for sport activities.

BACKGROUND

In general, a sports bra is a specialized undergarment designed primarily for women to provide essential support and comfort during physical activities. The sports bra is characterized by its snug-fitting, compression-like design, which helps reduce breast movement during physical exercise. It typically features wide, adjustable shoulder straps and an elastic band positioned beneath the bust. Sports bras are well-known in the fitness industry for their ability to provide essential support and stability through the use of removeable padding or removeable cups, which are often constructed from stretchable, moisture-wicking fabric, such as spandex or a blend of synthetic materials. However, traditional sports bras with removable components often encounter a range of issues that compromise their functionality, comfort, and longevity. For example, shifting or displacement of the removeable components during exercise may result in discomfort and frequent readjustment. Also, folding or wrinkling of the padding may lead to unevenness and discomfort. In addition, there is a concern of losing or misplacing the removable padding, as well as challenges related to maintenance and hygiene. As such, it would be desirable to provide a sports bra which cures one or more of the shortfalls of the previous approaches identified above.

SUMMARY

A supportive garment is disclosed, in accordance with one or more embodiments of the present disclosure. In embodiments, the supportive garment may include a front panel for covering at least a portion of a chest of a user. In embodiments, the front panel may include a first inner layer comprising a fixed cupless padding; a second inner layer comprising a perforated fabric overlaying and fixed to the fixed cupless padding, where the fixed cupless padding is positioned within an outer perimeter of the perforated fabric; and an outer layer encasing the first inner layer and the second inner layer, the outer layer comprising an elastic fabric. In embodiments, the supportive garment may include a set of straps. In embodiments, each strap of the set of straps may have a first end connecting to a top portion of the front panel and at least a second end connecting to a side portion of the front panel, where the straps wrap over the shoulders and at least partially around the torso of the user. In embodiments, the supportive garment may include a bottom band attached to a bottom portion of the front panel and the set of straps. In embodiments, the bottom band may define a torso opening and provide a secure fit to the torso of the user.

A supportive garment is disclosed, in accordance with one or more embodiments of the present disclosure. In embodiments, the supportive garment may include a bottom band. In embodiments, the bottom band may define a torso opening and provide a secure fit to a torso of a user. In embodiments, the supportive garment may include a front panel attached to a top portion of the bottom band. In embodiments, the front panel may include a first inner layer comprising a fixed cupless padding. In embodiments, the front panel may include a second inner layer comprising a perforated fabric and positioned proximate to the first inner layer, where the second inner layer may be fixed to the fixed cupless padding via at least one princess cut. In embodiments, the at least one princess cut may include one or more seams extending from an armhole to the bottom band. In embodiments, the front panel may include an outer layer encasing the first inner layer and the second inner layer. In embodiments, the outer layer may comprise an elastic fabric. In embodiments, the supportive garment may include a set of straps attached to a top portion of the bottom band. In embodiments, each strap may have a first end connecting to a top portion of the front panel and at least a second end connecting to a side portion of the front panel, where the set of straps wrap over the shoulders and at least partially around the torso of the user.

It is to be understood that both the foregoing general description and the following detailed description are exemplary and explanatory only and are not necessarily restrictive of the invention as claimed. The accompanying drawings, which are incorporated in and constitute a part of the specification, illustrative embodiments of the invention and together with the general description, serve to explain the principles of the invention.

BRIEF DESCRIPTION OF DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings. The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

In the context of athletic and fitness apparel, a conventional sports bra is a specialized undergarment designed primarily for women to provide essential support and comfort during physical activities. One example of a typical sports bra comprises two separate cups, often constructed from stretchable, moisture-wicking fabric, such as spandex or a blend of synthetic materials. These cups encase and support each breast individually, reducing motion and minimizing discomfort during exercise.

Traditional sports bras are well-known in the fitness industry for their ability to provide essential support and stability. However, such sports bras having removable padding or cups often encounter a range of issues that compromise their functionality, comfort, and longevity. These issues include shifting or displacement of the padding during exercise, resulting in discomfort and frequent readjustment. Folding or wrinkling of the padding, leading to unevenness and discomfort. There is also the concern of loss or misplacement of removable padding, as well as challenges related to maintenance and hygiene. Additionally, these sports bras may give rise to a bulky appearance and lack customization options to meet individual support needs. As such, there exists a clear need to provide a sports bra that overcomes one or more shortfalls of the previous approaches.

Embodiments of the present disclosure are directed to a cupless supportive garment with sewn-in padding. The cupless fixed padding configuration eliminates the issues related to shifting, folding, and loss of padding and ensures a consistent and comfortable fit during physical activities.

Referring generally to FIGS. 1-9, the cupless supportive garment 100 is disclosed, in accordance with one or more embodiments of the present disclosure.

FIGS. 1-7 illustrate perspective views of the supportive garment 100, in accordance with one or more embodiments of the present disclosure.

Figure 1:
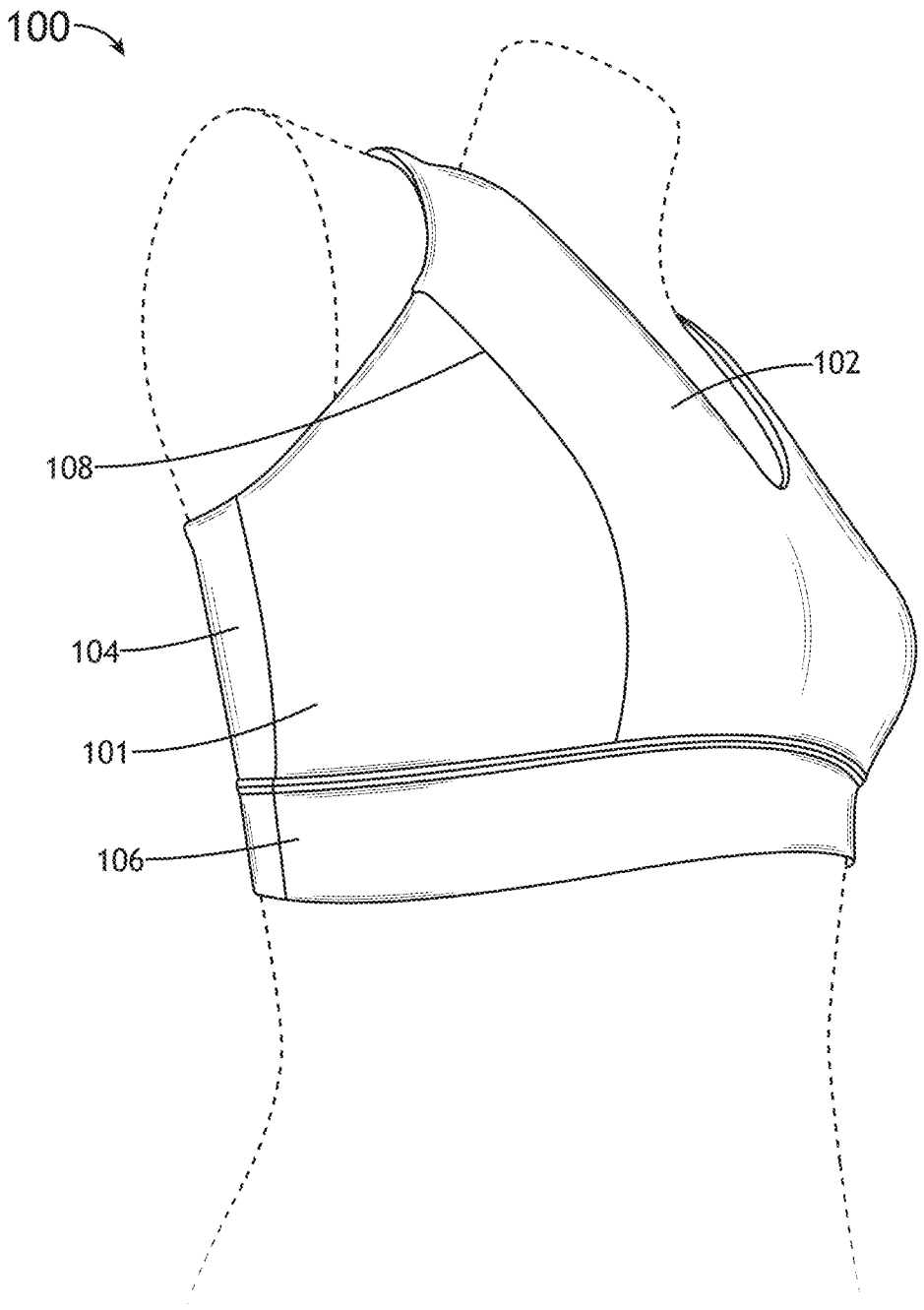
FIG. 1 is a front perspective view of a supportive garment, in accordance with one or more embodiments of the present disclosure.
Figure 2:
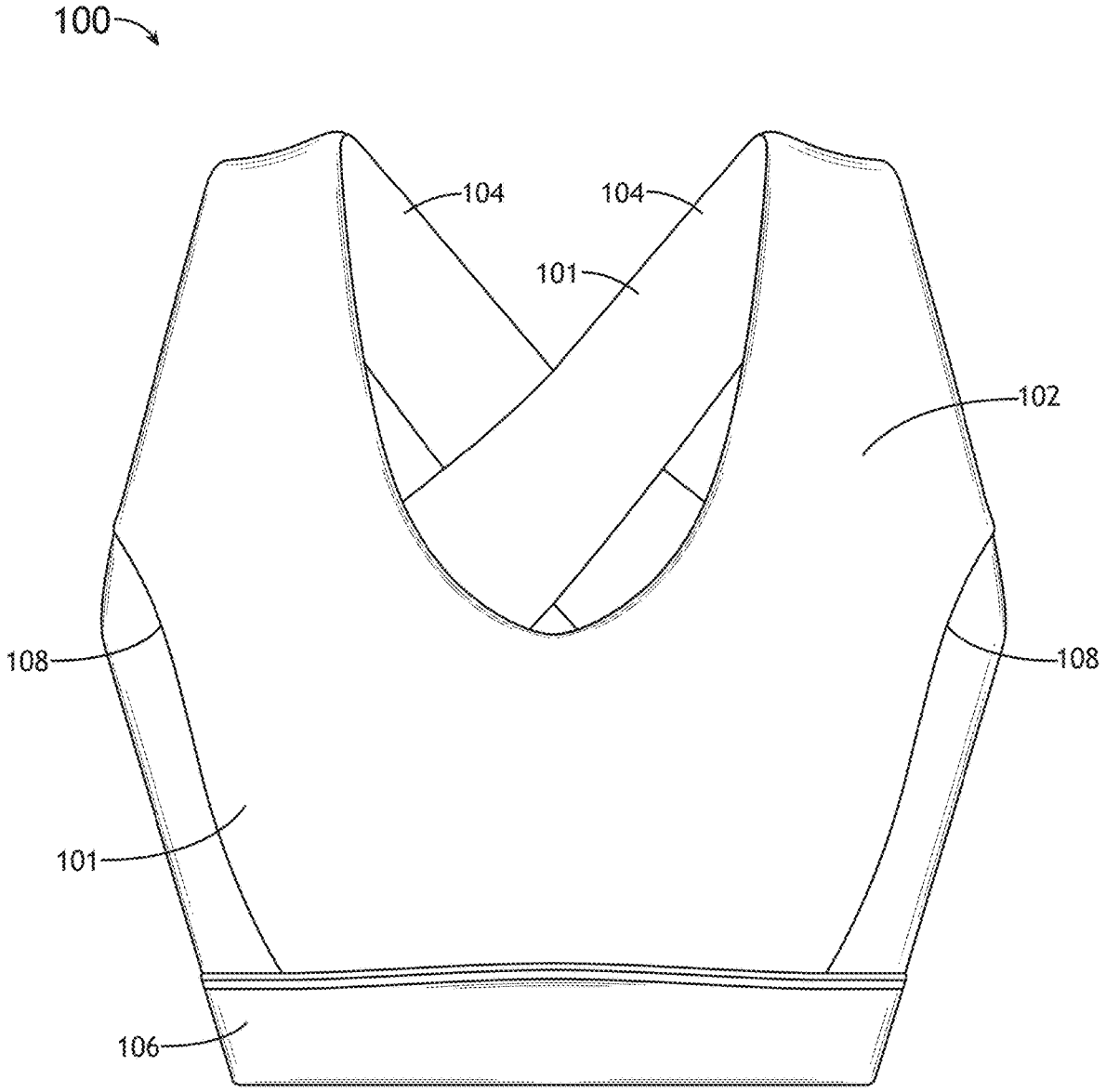
FIG. 2 is a front view of the supportive garment, in accordance with one or more embodiments of the present disclosure.
Figure 3:
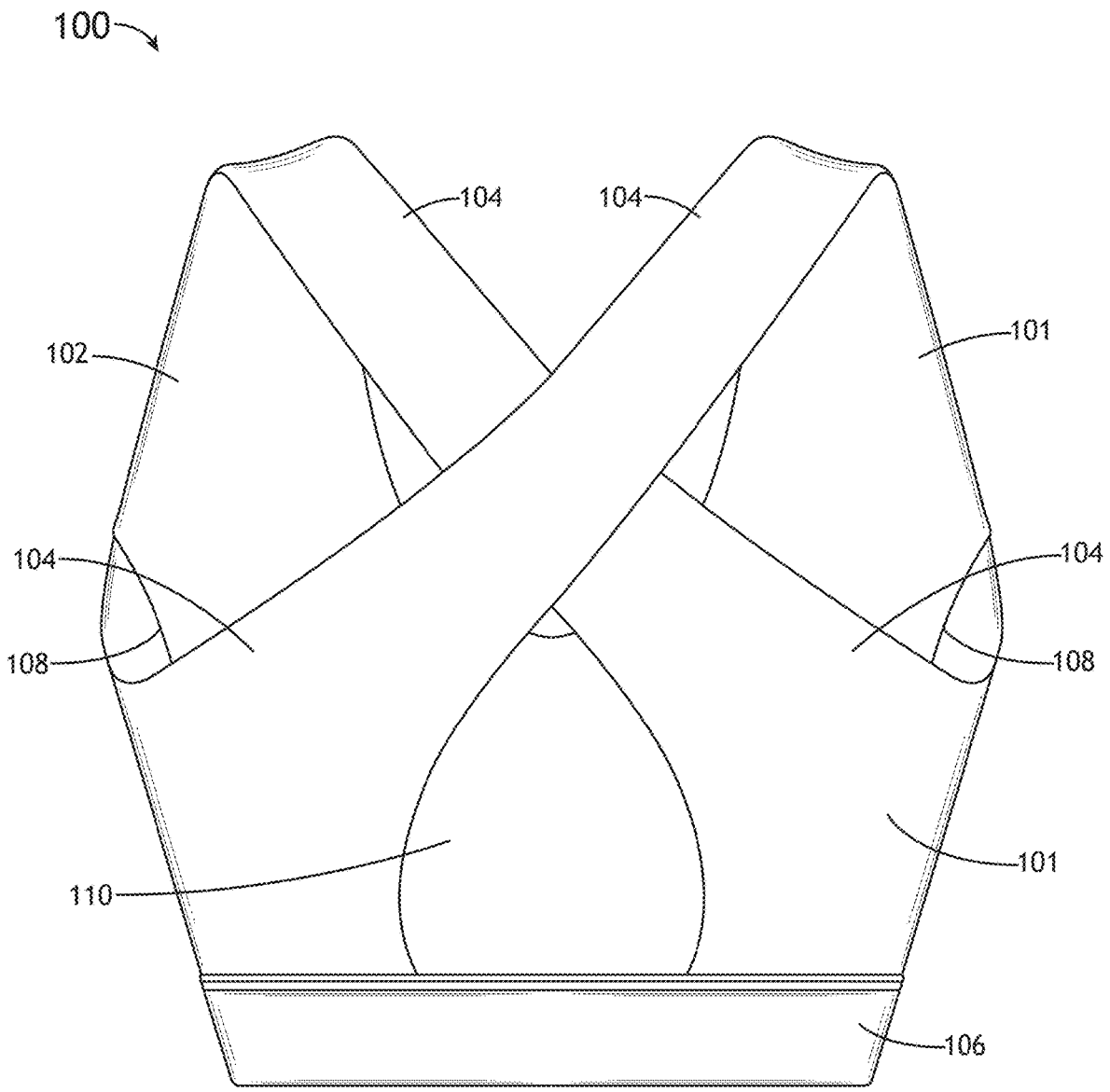
FIG. 3 is a rear view of the supportive garment, in accordance with one or more embodiments of the present disclosure.
Figure 4:
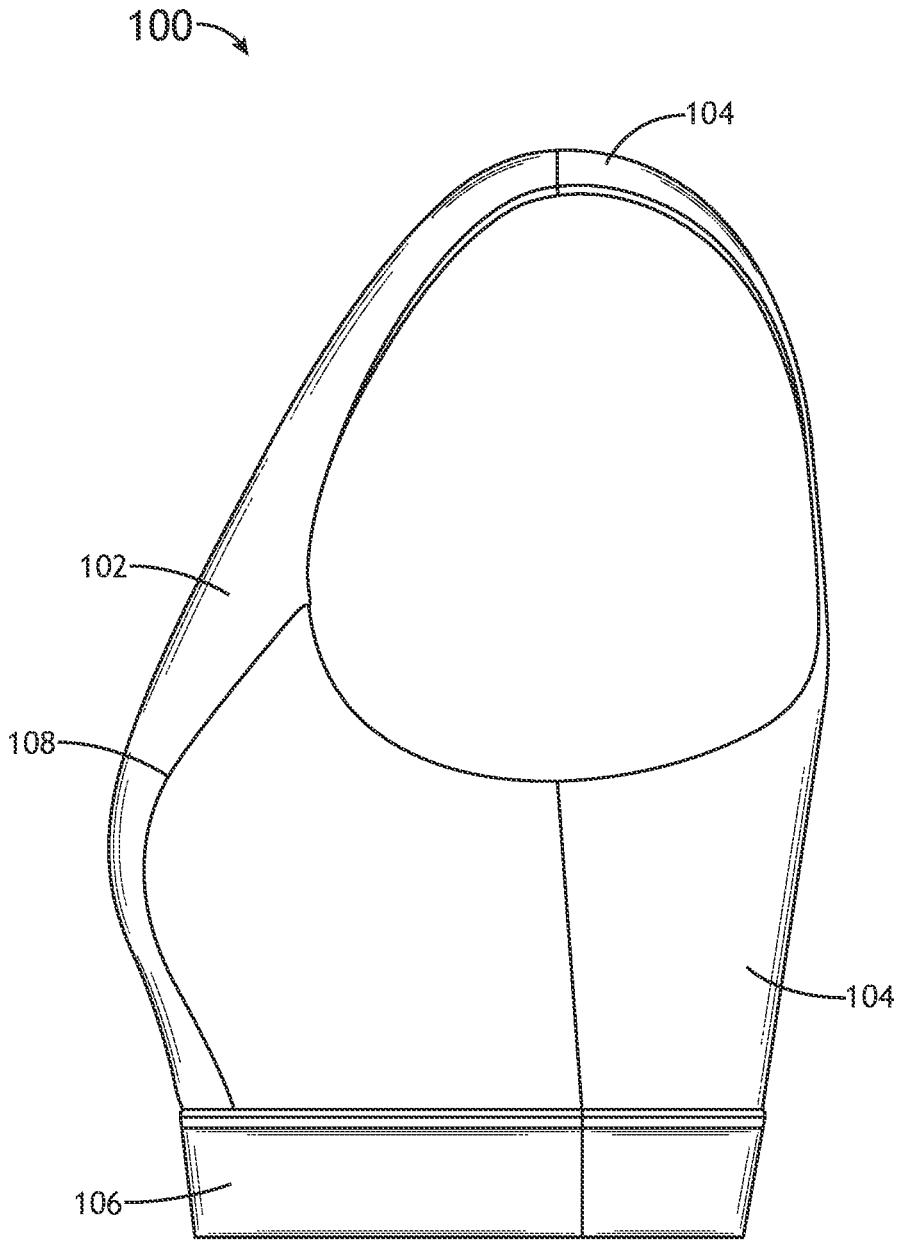
FIG. 4 is a left side view of the supportive garment, in accordance with one or more embodiments of the present disclosure.
Figure 5:
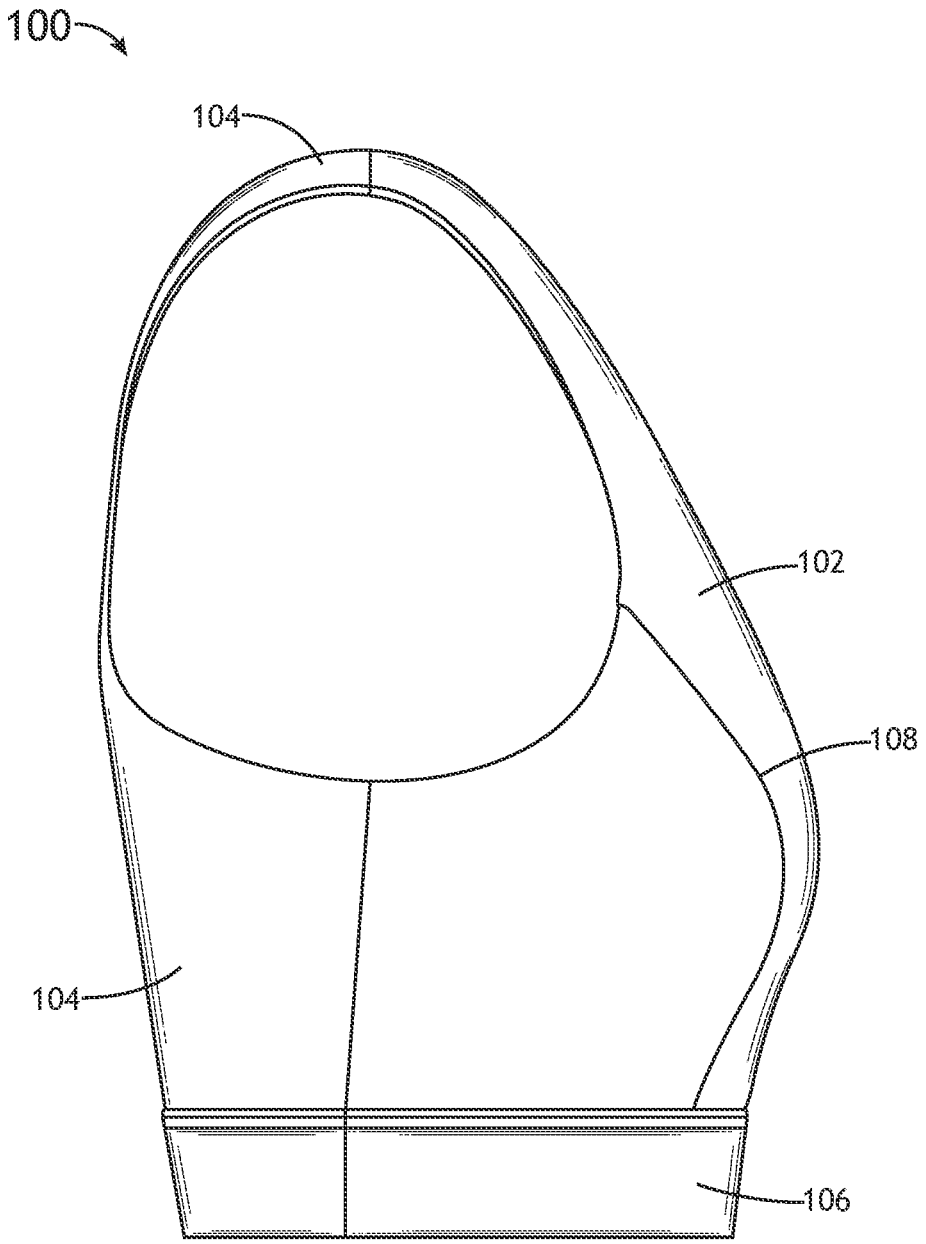
FIG. 5 is a right side view of the supportive garment, in accordance with one or more embodiments of the present disclosure.
Figure 6:
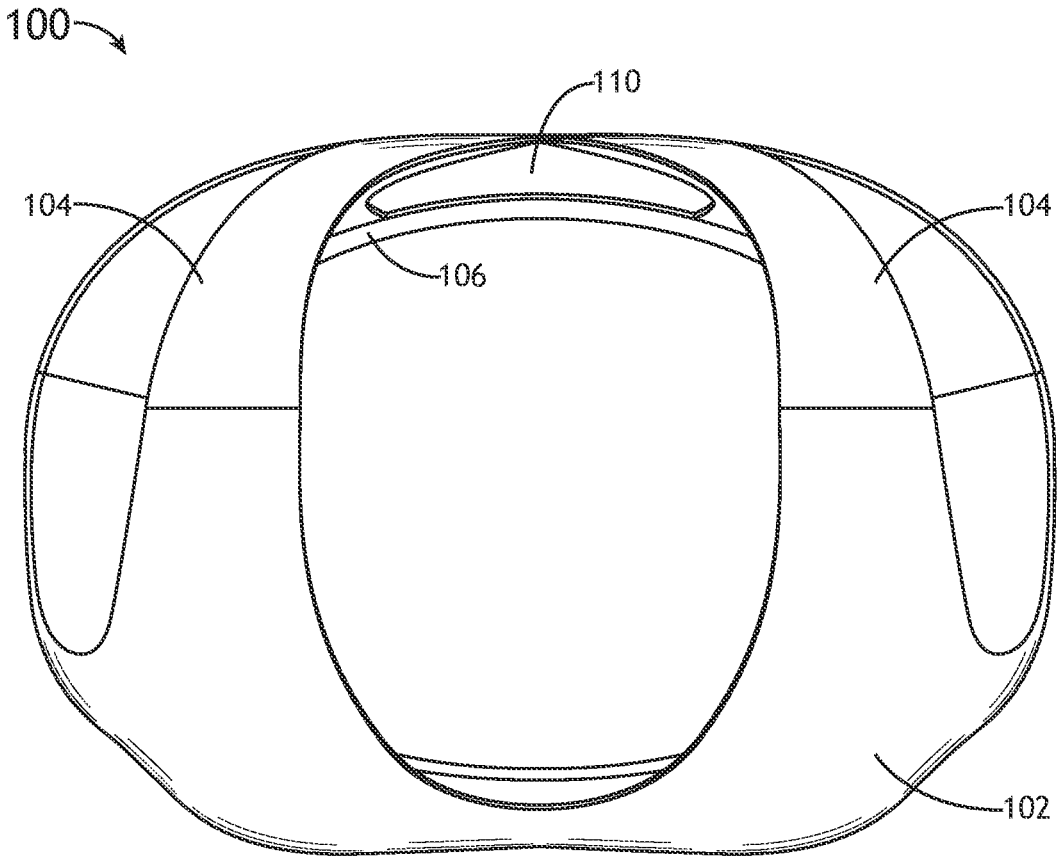
FIG. 6 is a top view of the supportive garment, in accordance with one or more embodiments of the present disclosure.
Figure 7:
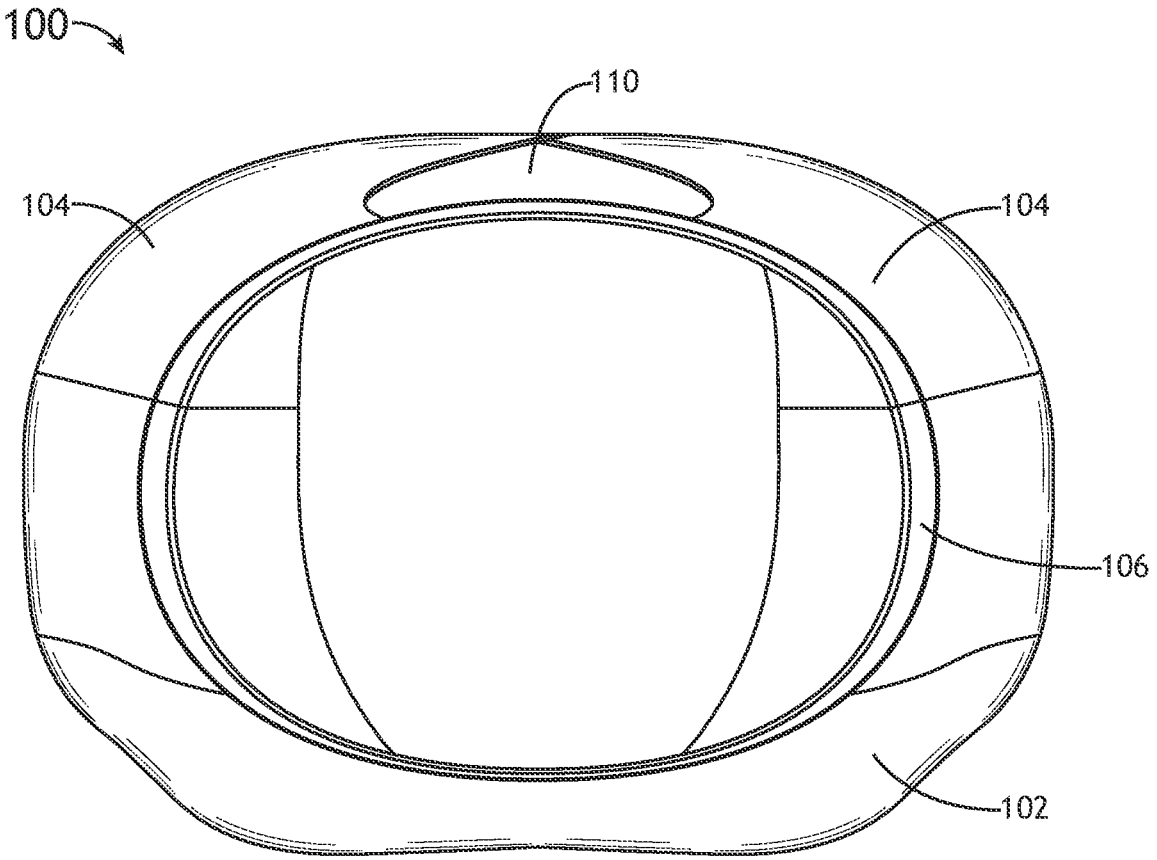
FIG. 7 is a bottom view of the supportive garment, in accordance with one or more embodiments of the present disclosure.
Figure 8:
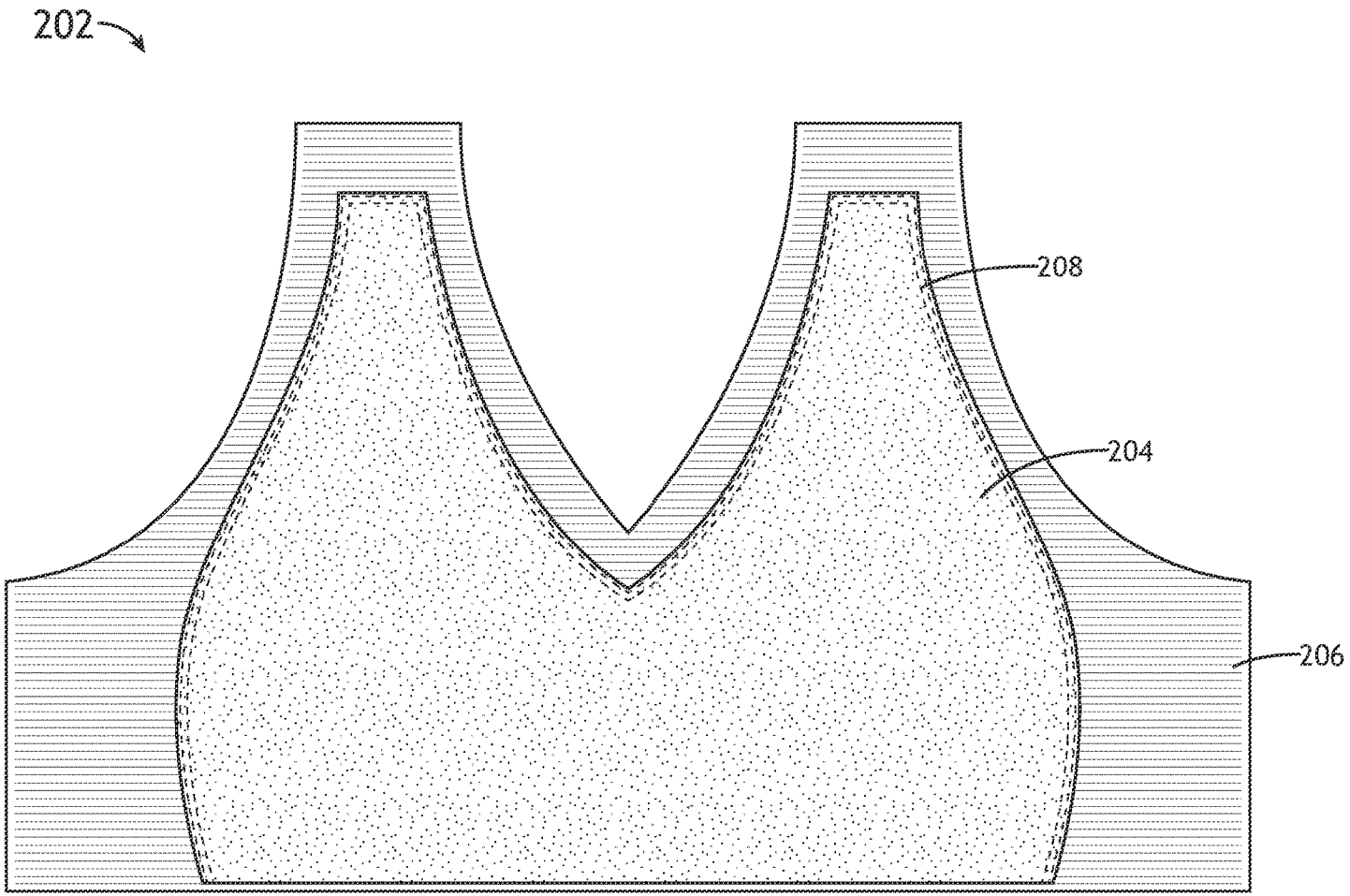
FIG. 8 is a front view of a padded assembly integrated within the supportive garment and FIG. 10A is a front view of the front panel of the supportive garment including the padded assembly, in accordance with one or more embodiments of the present disclosure.
Figure 9:
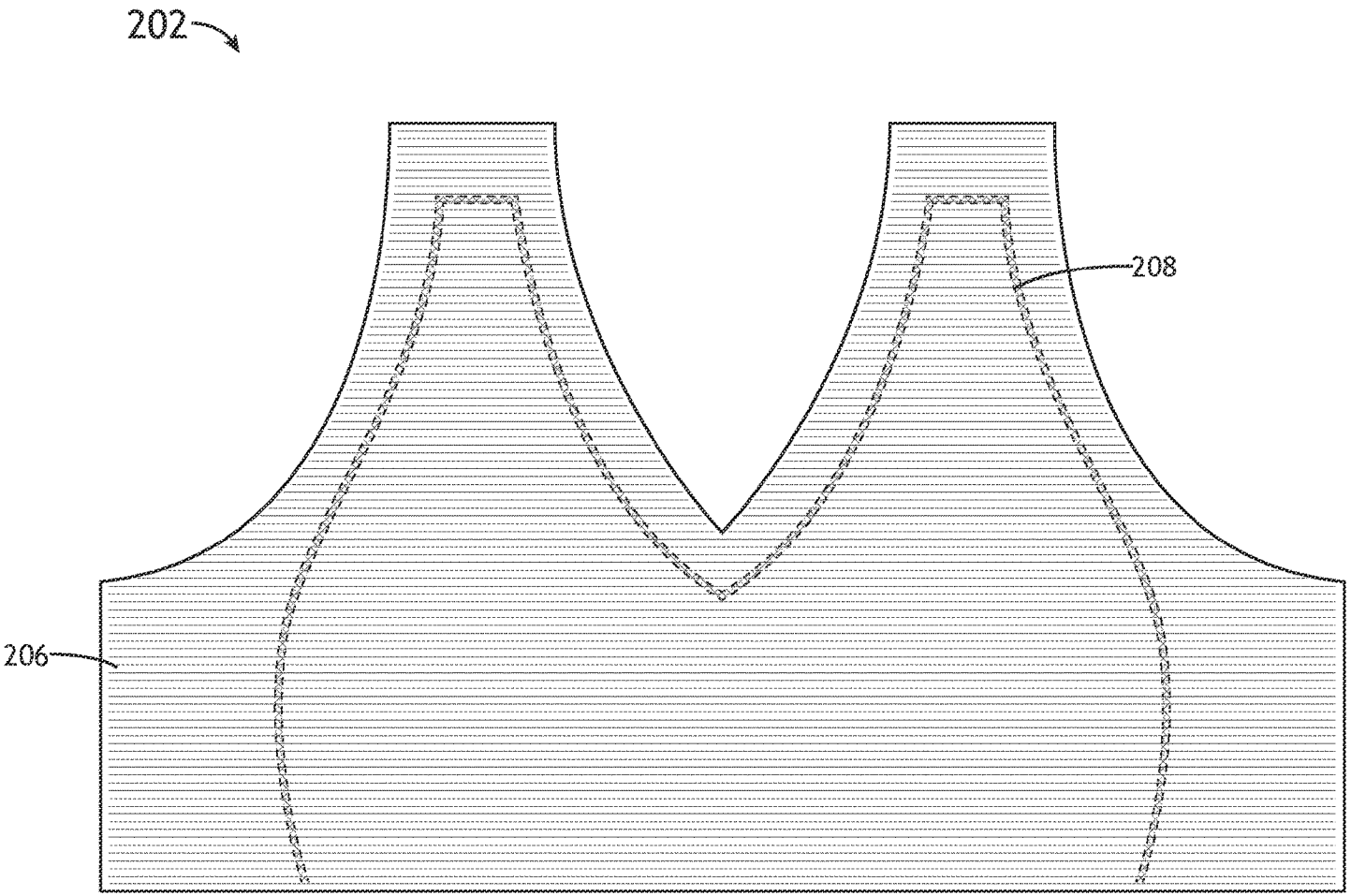
FIG. 9 is a rear view of the padded assembly integrated within the supportive garment and FIG. 10B is a rear view of the front panel of the supportive garment including the padded assembly, in accordance with one or more embodiments of the present disclosure.

In embodiments, the supportive garment 100 includes a front panel 102 that serves as the primary coverage for at least a portion of a user's chest. The front panel 102 may include a padded assembly 202, as shown in FIGS. 8-9. For example, the padded assembly 202 may include a first inner layer and a second inner layer. In embodiments, the first inner layer of the padded assembly 202 includes a fixed cupless padding 204. The fixed cupless padding 204 is configured to provide reliable support and ensure a comfortable fit to the user. By way of another example, the fixed cupless padding 204 may be formed from a compressive material such as, but not limited to, Neoprene. For example, the fixed cupless padding 204 may be formed from Neoprene material that is free of Bisphenol A (BPA), making the supportive garment 100 eco-friendly and a safe choice for users.

Moreover, the inclusion of the fixed cupless padding 204 within the front panel 102 brings significant advantages. Unlike traditional bras with fixed cup sizes, the supportive garment 100 of the present disclosure does not limit a user to choose from a fixed cup size. By employing a dual-sizing method that considers both the user's torso measurement (e.g., rib cage measurement) and their breast size, the supportive garment 100 improves its customization and inclusivity. It ensures that the user can find the perfect fit while complementing their individual body shape and size, promoting optimal support, comfort, and confidence.

In embodiments, the padded assembly 202 may include a second inner layer made from a perforated fabric 206. For example, the perforated fabric may be configured as an overlay securely fixed to the fixed cupless padding 204. By way of another example, the perforated fabric 206 of the second inner layer and the fixed cupless padding 204 of the first inner layer may be securely fixed together through the use of a cover stitch 208. By way of another example, the fixed cupless padding 204 of the first layer may be positioned within an outer perimeter of the perforated fabric 206 of the second inner layer. By way of another example, the fixed cupless padding 204 may be positioned in front of the perforated fabric 206. This configuration will provide ventilation, effective moisture management, and overall breathability, which in turn keeps the user comfortable during various physical activities.

Figure 10A:
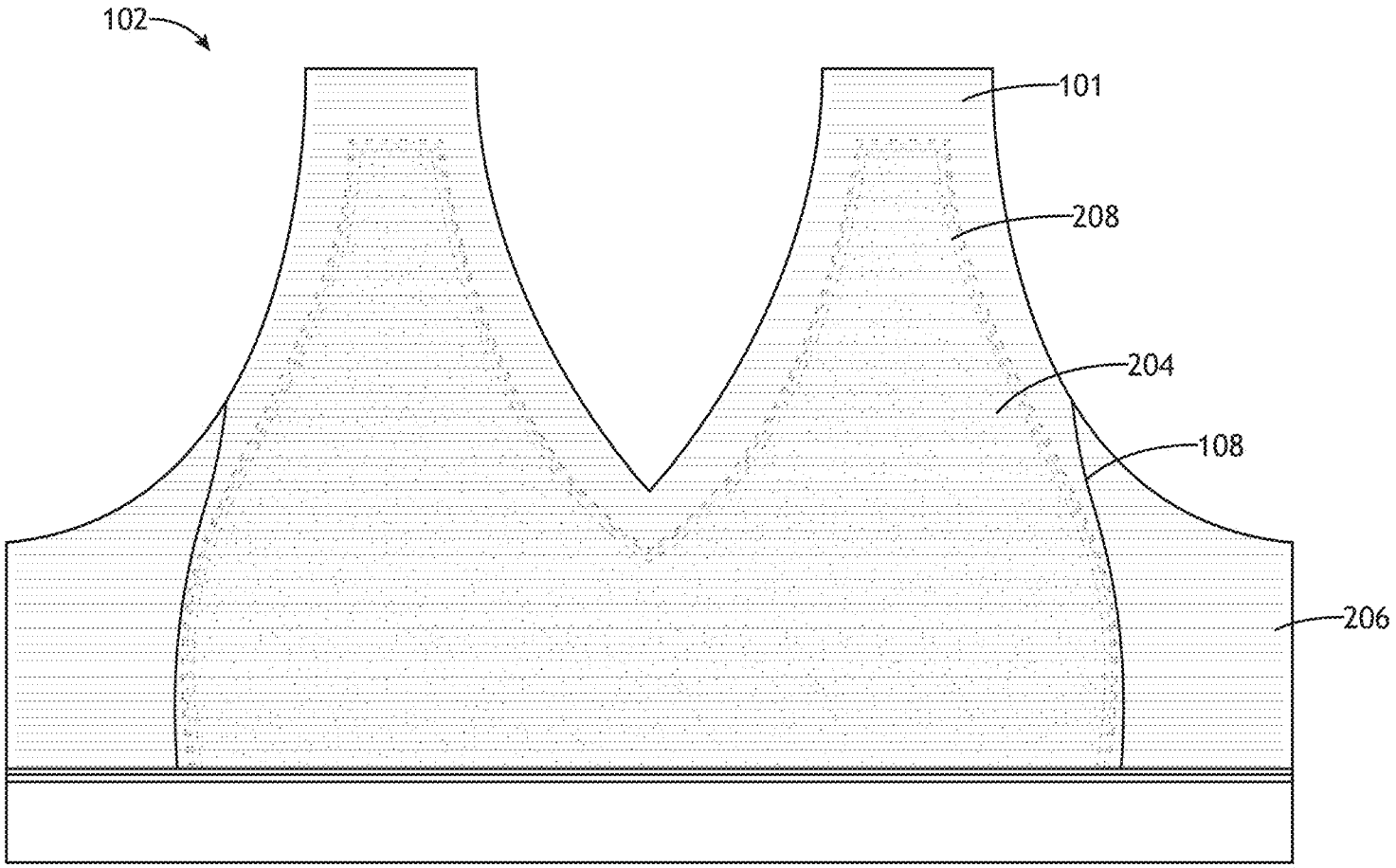
Figure 10B:
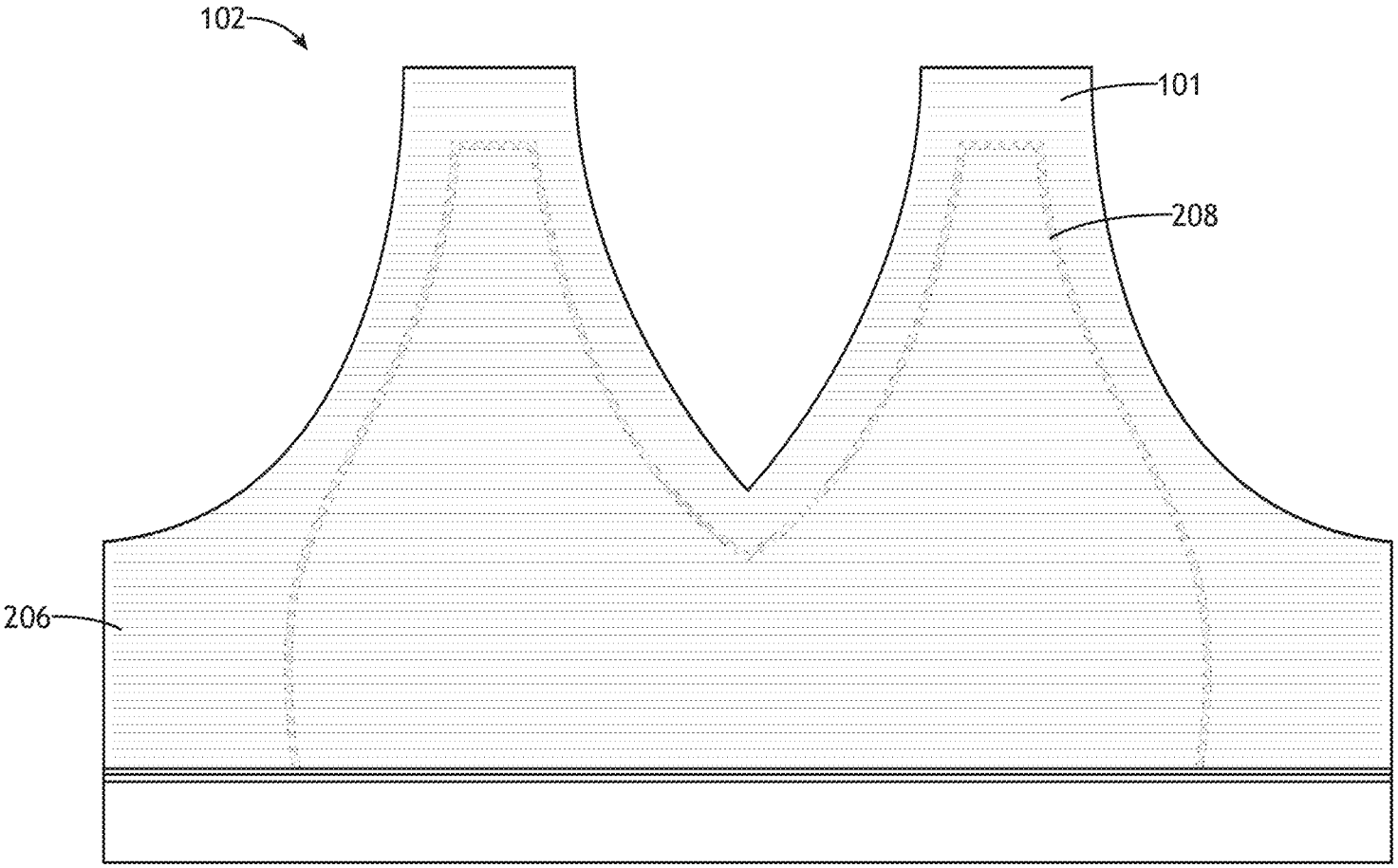

In embodiments, the front panel 102 may include an outer layer of elastic fabric 101. For example, as shown in FIGS. 10A-10B, the fixed cupless padding 204 and the perforated fabric 206 of the padded assembly 202 may be securely enclosed within the outer layer of elastic fabric 101. The outer layer of elastic fabric 101 may help to ensure that the inner layers 204, 206 of the padded assembly 202 are held in place, while also providing a snug and secure fit for the user.

In embodiments, the supportive garment 100 may include a set of straps 104. For example, each strap of the set of straps 104 may include a first end and a second end. The first end of each strap may be affixed to a top portion of the front panel, while the second end of each strap may be affixed to a side portion of the front panel. By way of another example, each strap of the set of straps 104 may be devoid of the padding and/or mesh materials present in the inner layers. Instead, the set of straps 104 may be comprised of an elastic fabric, which allows each strap of the set of straps 104 to wrap over the shoulders and at least partially around the torso of the user.

In embodiments, one or more upper portions of the front panel 102 may be configured to extend in an upward direction towards at least a portion of the shoulders of a user and transition into the first end of each strap of the set of straps 104 set of straps 104. In embodiments, one or more side portions of the front panel 102 may be configured to extend in a lateral direction around at least a portion of the torso of a user and transition into the second end of each strap of the set of straps 104.

In embodiments, at least one of the straps of the set of straps 104 may be configured to overlap the other strap of the set of straps 104, forming a cross pattern. For example, the cross pattern may create an opening 110 in the back of the supportive garment 100. It is noted herein that the size and shape of the opening 110 may vary based on the size and specific measurements of the user.

It is noted herein that the set of straps 104 of the supportive garment 100 are thoughtfully designed to cater to the unique and diverse needs of a user. The elastic fabric that is utilized for the set of straps 104 allows for the accommodation of women with varying rib cage sizes and breast sizes. This adaptability is a pivotal feature, ensuring that the supportive garment 100 provides a personalized and secure fit, irrespective of the varying body proportions of a user. In embodiments, the supportive garment 100 may include a bottom band 106. For example, the bottom band 106 may define a torso opening in the supportive garment 100. The torso opening allows the supportive garment 100 to be easily put on by fitting it over the head of a user and securing it firmly around the torso of the user. By way of another example, the bottom band 106 may be attached to at least a bottom portion of the front panel 102 and at least a bottom portion of the set of straps 104.

In embodiments, the front panel 102 of the supportive garment 100 may include at least one princess cut pattern 108. For example, the at least one princess cut pattern 108 may include one or more seams extending from an armhole to a top portion of the bottom band 106. By way of another example, the one or more seams may include at least one of one or more curved seams or one or more straight vertical seams. The one or more seams may be positioned through a central portion of the front panel 102 such that a central reinforcement zone is created. This reinforcement zone may effectively support the breasts of the user during various physical activities.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken limiting.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A supportive garment comprising:

a front panel for covering at least a portion of a chest of a user, the front panel comprising:

a padded assembly, the padded assembly comprising:

a first inner layer comprising a fixed cupless padding; and a second inner layer comprising a perforated fabric overlaying and fixed to the fixed cupless padding, wherein the fixed cupless padding is positioned within an outer perimeter of the perforated fabric; and an outer layer configured to enclose the padded assembly, the outer layer comprising an elastic fabric;

a set of straps, each strap having a first end integrated with a top portion of the front panel and at least a second end forming a back panel covering at least a portion of a torso of the user, wherein the back panel connects to a side portion of the front panel, wherein each strap wraps over a shoulder of the user and at least partially around the torso of the user; and a bottom band attached to a bottom portion of the front panel and a bottom portion of the back panel formed by the set of straps, the bottom band defining a torso opening and configured to provide a secure fit to the torso of the user.

2. The supportive garment of claim 1, wherein the first inner layer comprising the fixed cupless padding is positioned in front of the perforated fabric of the second inner layer.

3. The supportive garment of claim 1, wherein the second inner layer is attached to the fixed cupless padding of the first inner layer via a cover stitch.

4. The supportive garment of claim 1, wherein the fixed cupless padding of the first inner layer comprises a Neoprene material free of Bisphenol A (BPA).

5. The supportive garment of claim 1, wherein the set of straps includes a first strap and a second strap, wherein the first strap of the set of straps is configured to overlap the second strap of the set of straps forming a cross pattern.

6. The supportive garment of claim 5, wherein the set of straps is configured to create an opening in a back of the supportive garment, the opening defined by at least a portion of the bottom band, the first strap, and the second strap.

7. The supportive garment of claim 6, wherein a shape and a size of the opening will vary based on a size of the user.

8. The supportive garment of claim 1, wherein at least a portion of the front panel comprises at least one princess cut pattern, the at least one princess cut pattern including one or more seams extending from an armhole to the bottom band.

9. The supportive garment of claim 8, wherein the at least one princess cut pattern includes at least one of one or more curved seams or one or more straight vertical seams extending from the armhole to the bottom band.

10. The supportive garment of claim 9, wherein the one or more seams of the at least one princess cut pattern is configured to form a central reinforcement zone in a central portion of the front panel and configured to support breasts of the user.

11. A supportive garment comprising:

a bottom band configured to define a torso opening and provide a secure fit to a torso of a user;

a front panel attached to a top portion of the bottom band, the front panel comprising:

a padded assembly, the padded assembly comprising:

a first inner layer comprising a fixed cupless padding;

a second inner layer comprising a perforated fabric and positioned proximate to the first inner layer, wherein the second inner layer is fixed to the fixed cupless padding of the first inner layer via a cover stitch;

at least one princess cut pattern, wherein the at least one princess cut pattern includes one or more seams extending from an armhole to the bottom band; and an outer layer configured to enclose the padded assembly, the outer layer comprising an elastic fabric; and a set of straps attached to a top portion of the bottom band, each strap having a first end integrated with a top portion of the front panel and at least a second end forming a back panel covering at least a portion of the torso the user, wherein the back panel connects to a side portion of the front panel, wherein each strap wraps over a shoulder of the user and at least partially around the torso of the user.

12. The supportive garment of claim 11, wherein the first inner layer comprising the fixed cupless padding is positioned in front of the perforated fabric of the second inner layer.

13. The supportive garment of claim 11, wherein the fixed cupless padding of the first inner layer comprises a Neoprene material free of Bisphenol A (BPA).

14. The supportive garment of claim 13, wherein the set of straps includes a first strap and a second strap, wherein the first strap of the set of straps is configured to overlap the second strap of the set of straps.

15. The supportive garment of claim 14, wherein the set of shoulder straps is configured to create an opening in a back of the supportive garment, the opening defined by at least a portion of the bottom band, the first strap, and the second strap.

16. The supportive garment of claim 15, wherein a shape and a size of the opening will vary based on a size of the user.

17. The supportive garment of claim 16, wherein the at least one princess cut pattern includes at least one of one or more curved seams or one or more straight vertical seams extending from the armhole to the bottom band.

18. The supportive garment of claim 17, wherein the one or more seams of the at least one princess cut pattern is configured to form a central reinforcement zone in a central portion of the front panel and configured to support breasts of the user.

* * * * *